US005675218A

United States Patent [19]

Mochizuki et al.

[11] Patent Number: 5,675,218

[45] Date of Patent: Oct. 7, 1997

[54] INCANDESCENT LAMP AND A LIGHTING APPARATUS USING THE LAMP

[75] Inventors: Hideto Mochizuki; Makoto Bessho; Tetsuya Sugano, all of Yokosuka, Japan

[73] Assignee: Toshiba Lighting & Technology Corporation, Tokyo, Japan

[21] Appl. No.: 580,022

[22] Filed: Dec. 20, 1995

[30] Foreign Application Priority Data

Dec. 21, 1994 [JP] Japan ..... 6-318739
Sep. 28, 1995 [JP] Japan ..... 7-250760

[51] Int. Cl.[6] ..... H01K 1/18

[52] U.S. Cl. ..... 313/578; 313/112; 313/271; 313/277; 313/279; 313/285; 313/292

[58] Field of Search ..... 313/578, 112, 313/579, 580, 271, 274, 275, 276, 277, 279, 264, 284, 285, 292

[56] References Cited

U.S. PATENT DOCUMENTS

| | | | |
|---|---|---|---|
| 3,466,489 | 9/1969 | Audesse et al. | 313/279 X |
| 3,497,753 | 2/1970 | Huston, Jr. | 313/578 X |
| 3,910,960 | 10/1975 | Danko | 313/579 |
| 3,930,177 | 12/1975 | Martin | 313/271 |
| 5,093,601 | 3/1992 | Watanabe et al. | 313/578 X |
| 5,270,609 | 12/1993 | Smith | 313/271 |

FOREIGN PATENT DOCUMENTS

| | | | |
|---|---|---|---|
| 0 242 816 | 10/1987 | European Pat. Off. . | |
| 57-38557 | 3/1982 | Japan . | |
| 63-289755 | 11/1988 | Japan | 313/578 |
| 6-005266 | 1/1994 | Japan | 313/578 |

*Primary Examiner*—Ashok Patel
*Attorney, Agent, or Firm*—Cushman, Darby & Cushman IP Group of Pillsbury Madison & Sutro LLP

[57] ABSTRACT

An incandescent lamp has an envelope having a bulbous portion including a wall defining a space, a thin tube extending outwardly along a central axis of the bulbous portion so as to communicate with the space, and a sealed portion located on an opposite end of the bulbous portion from the thin tube. The wall has a slope inclined toward the thin tube. A filament is provided along the central axis of the bulbous portion. An optical interference layer is arranged on a surface of the wall for reflecting infrared rays toward the filament. A first lead wire has a first end portion fixed in the sealed portion of the envelope, a second end portion coupled to one end of the filament and an intermediate U-shaped portion inserted into the thin tube for regulating a position of the filament. A second lead wire has a first end portion fixed in the sealed portion of the envelope and a second end portion coupled to another end of the filament.

14 Claims, 3 Drawing Sheets

FIG. 3
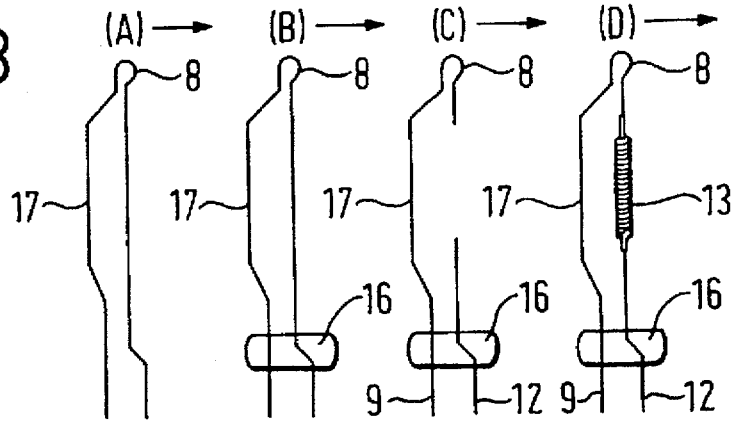
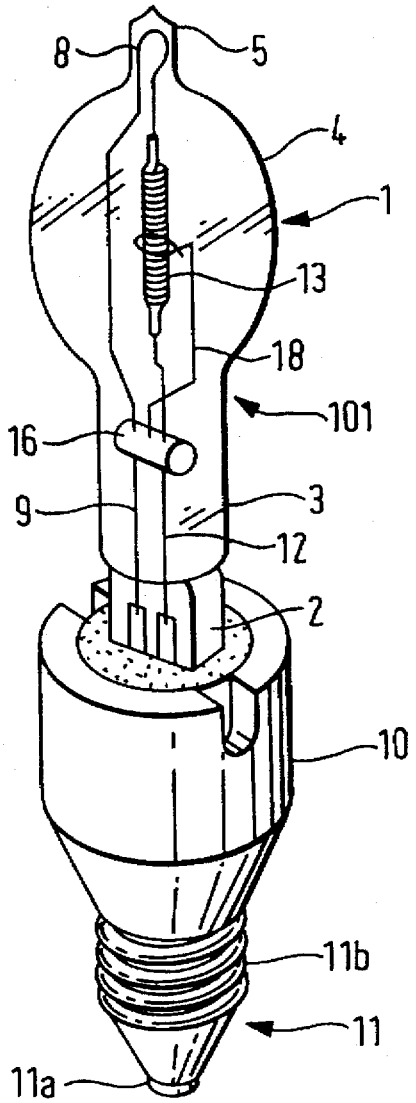
FIG. 4

INCANDESCENT LAMP AND A LIGHTING APPARATUS USING THE LAMP

BACKGROUND OF THE INVENTION

1. Field of the Invention

The present invention relates to incandescent lamps. In particular, the invention relates to an incandescent lamp having an optical interference layer arranged on a surface thereof.

2. Description of the Related Art

A recently developed and sold incandescent lamp, filled with a halogen gas, includes an infrared ray reflecting film formed on the surface of the envelope. Of the light emitted by the filament, infrared rays are reflected by the reflecting film and returned to the filament, while visible light is transmitted. The returning infrared rays heat the filament to increase the efficiency of the incandescent lamp. At the same time, the amount of infrared rays emitted outside the incandescent lamp is reduced.

In order to maximize the efficiency of the incandescent lamp, the filament should be disposed at a center of the envelope. Because a conventional incandescent lamp typically has a spherical, elliptical or cylindrical envelope, the amount of infrared rays returning to the filament increases when the filament of the incandescent lamp is located at the center of the envelope. Therefore, when the filament is located on the center line of the envelope, the infrared rays, which are reflected by the reflecting film, will return to the filament with certainty. The percentage of infrared rays returning to the filament is known as the geometric gain factor. The geometrical gain factor increases as the filament is located nearer the center line of the envelope.

When an envelope of the lamp has only one sealed portion, which is called a single seal type envelope, a pair of lead wires is fixed only at the sealed portion. Accordingly at an end opposite the sealed portion, which is at the top of the envelope, the filament tends to be positioned away from the center line of the envelope. As a result, the geometric gain factor decreases.

In incandescent lamps having no reflecting film, an envelope has been proposed having means for supporting a lead wire at an end opposite the sealed portion in order to maintain mechanical strength against shock. Japanese Laid Open Patent Application No. 57-38557/1982 discloses a lamp having an U-shaped support wire inserted into an exhaust tube located at an end opposite the sealed portion. The support in such an incandescent lamp may be utilized for regulating the position of the filament. However, it is difficult to locate the filament exactly on a center of the envelope.

SUMMARY OF THE INVENTION

Accordingly, the invention has as a primary object the provision of an incandescent lamp that enables the filament to lie closer to a center line of the envelope.

According to this invention an incandescent lamp includes an envelope having a bulbous portion including a wall defining a space, a thin tube extending outwardly along a central axis of the bulbous portion so as to communicate with the space, and a sealed portion located on an opposite side to the thin tube. The wall has a slope inclining toward the thin tube. A filament is provided along the central axis of the bulbous portion. An optical interference layer is arranged on a surface of the wall for reflecting infrared rays toward the filament. A first lead wire has a first end portion fixed in the sealed portion of the envelope, a second end portion coupled to one end of the filament and an intermediate U-shaped portion inserted into the thin tube for regulating the position of the filament. A second lead wire has a first end portion fixed in the sealed portion of the envelope and a second end portion coupled to the other end of the filament.

According to a preferred embodiment, the bulbous portion of the envelope further includes a spheroidal portion having two focuses, each focus being positioned near one end of the filament. The filament may also be formed of a coiled wire which itself is coiled (double coiled). The second end portion of the first lead wire may be inserted into an end portion of the filament that is singly coiled for coupling therebetween.

These and other aspects of the invention are further described in the following drawings and detailed description of the invention.

BRIEF DESCRIPTION OF THE DRAWINGS

The invention will be described in more detail below in conjunction with the following drawings of which:

FIGS. 3A–3D are illustrations of a manufacturing process for a mount used in the first embodiment of the present invention;

FIG. 4 is a front view of an incandescent lamp according to a second embodiment of the present invention;

DETAILED DESCRIPTION OF THE PRESENTLY PREFERRED EXEMPLARY EMBODIMENTS

Figure 1:
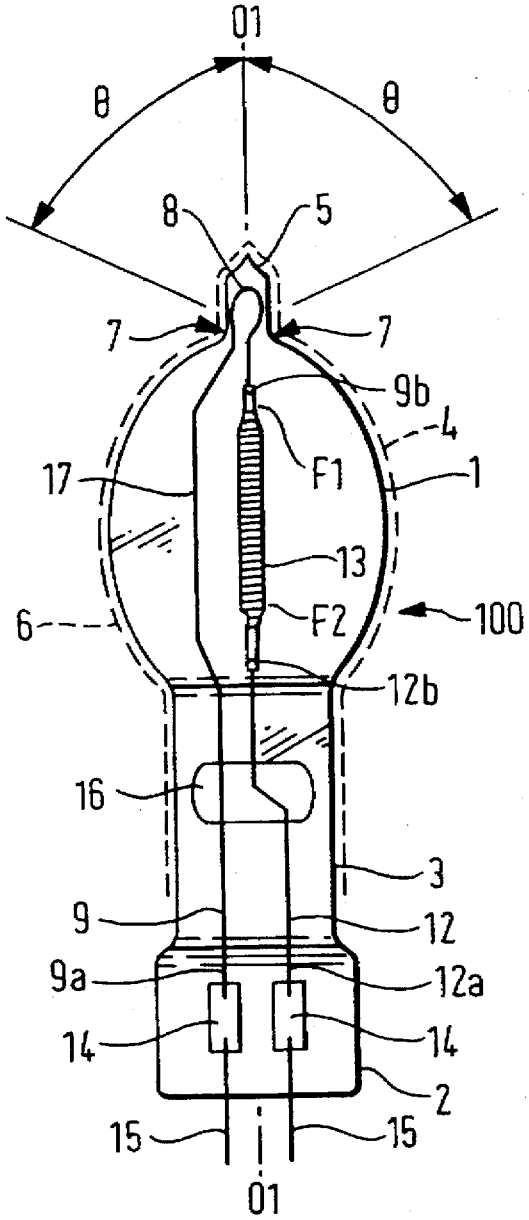
FIG. 1 is a partial from view of an incandescent lamp according to a first embodiment of the present invention.
Figure 2:
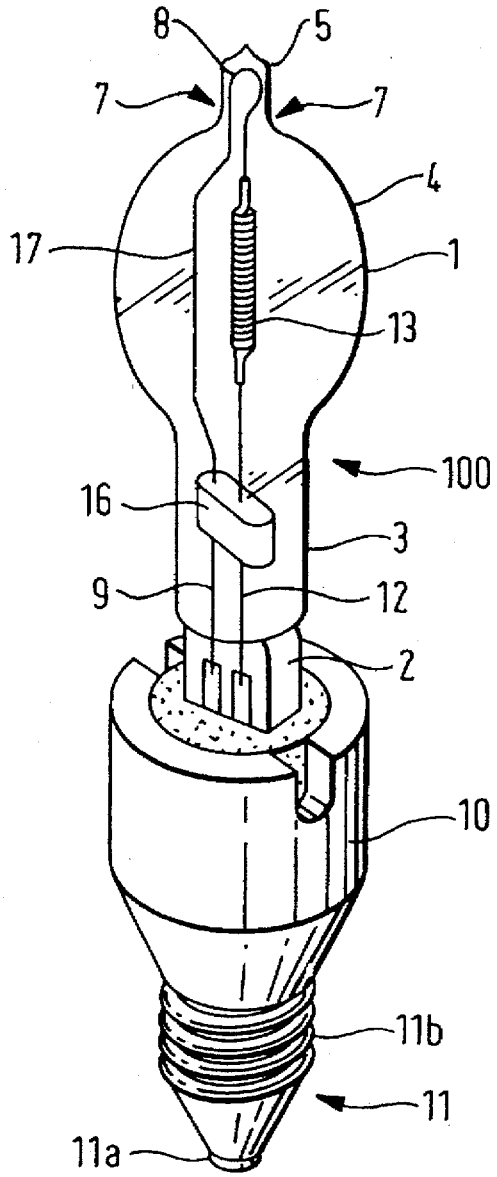
FIG. 2 is a perspective view of the incandescent lamp shown in FIG. 1.

Referring now to FIGS. 1 and 2, a first embodiment of this invention will be explained.

FIG. 1 shows an incandescent lamp 100. A fused silica envelope 1 of the incandescent lamp 100 is continuously formed with a sealed portion 2 at one end, a cylindrical neck portion 3, a bulbous portion 4 and a thin tube 5 provided at the other end. Bulbous portion 4 of envelope 1 is a spheroid having a long axis between sealed portion 2 and thin tube 5. The long axis corresponds to a central axis of the envelope 1 (O1–O1).

Bulbous portion 4 of envelope 1 is so formed that it has first focal point F1 and second focal point F2 on the central axis O1–O1 of envelope 1, when a wall of bulbous portion 4 is coated with an optical interference layer 6.

The wall of bulbous portion 4 has a slope 7 inclined toward thin tube 5 for easily inserting an intermediate U-shaped bend portion 8 of a first lead wire 9, described below, into thin tube 5. Slope 7 of the wall near thin tube 5 has an inclination of about 70 degrees to the central axis O1–O1. It is preferable that the angle of inclination indicated by $\Theta$ is not more than 70 degrees to the central axis O1–O1. If the angle of inclination exceeds 70 degrees, it is difficult to smoothly insert intermediate U-shaped bend portion 8 into thin tube 5.

As shown in FIG. 2, sealed portion 2 of envelope 1 is attached to a ceramic base 10 with adhesives (not shown). In this embodiment, a metal cap 11 is formed on an end of ceramic body 10. Cap 11 is an Edison screw type cap.

Returning to FIG. 1, thin tube 5 of envelope 1 extends outwardly along the central axis O1–O1 of envelope 1. Thin tube 5 is typically an exhaust tube for pumping air from envelope 1 and refilling envelope 1 with a mixture of an inert gas and a halogen gas. If the inner diameter of thin tube 5 is less than 2.5 mm, it is difficult to pump the air efficiently from envelope 1. If the inner diameter of thin tube 5 is more than 6.0 mm, the effective area of an optical interference film 6 on bulbous portion 4 becomes small. Accordingly, the diameter of thin tube 5 is preferably selected to be 2.5 mm to 6.0 mm.

Optical interference layer 6, indicated by a dot line, is arranged on an external surface of the wall. Optical interference layer 6 includes a plurality of high refractive index layers made of a metal oxide substance, preferably titanium oxide ($TiO_2$), tantalum oxide ($Ta_2O_5$) zirconium oxide ($ZrO_2$) or zinc sulfide (ZnS), alternated with a plurality of low refractive index layers made of a metal oxide substance, preferably silicon oxide ($SiO_2$) or magnesium fluoride ($MgF_2$).

The high refractive index layers and the low refractive index layers are alternately stacked on each other for a total of 6–80 layers. Optical interference layer 6 transmits visible light and reflects infrared rays in accordance with light interference.

A first lead wire 9 and a second lead wire 12 are made of tungsten. Filament 13 is connected across ends **9*b* and 12*b* of lead wires 9 and 12, respectively. Ends 9*a* and 12*a* of lead wires 9 and 12 are connected to separate thin molybdenum foils 14 which in turn, are connected to outer lead wires 15. Ends 9*a* and 12*a*, foils 14 and one of the ends of outer lead wires 15 are fixed in sealed portion 2 of envelope 1. Outer lead wires 15 are connected to a top contact 11*a* and a cap shell 11*b* of cap 11, respectively (as shown in FIG. 2**).

First and second lead wires 9 and 12 pass through a glass support bridge 16 at cylindrical neck portion 3 of envelope 1 so that they are isolated from each other.

First lead wire 9 is so shaped that it has an overhang 17 near filament 13 to avoid heating. First lead wire 9 further has an intermediate bend portion 8 inserted into thin tube 5. Intermediate bend portion 8 has a U-shaped configuration. Intermediate U-shaped bend portion 8 prevents first lead wire 9 from inclining from axis O1–O1 of bulbous portion so that the position of first lead wire 9 is controlled. First lead wire 9 has a preferable outer diameter between 0.2 mm and 0.55 mm. If the outer diameter of first lead wire 9 is less than 0.2 mm, the mechanical strength of first lead wire 9 is insufficient for supporting filament 13. If the outer diameter of first lead wire 9 is more than 0.55 mm, first lead wire 9 impedes the pumping of all of the air from envelope 1 through thin tube 5.

End portion **9*b* of first lead wire 9 has a straight configuration extending along the central axis O1–O1 of envelope 1. Similarly, end portion 12*b* of second lead wire 12 has a straight configuration extending along the central axis O1–O1 of envelope 1**.

Filament 13 is made of tungsten and is straight and formed with a coiled wire, which is itself coiled for at least a central portion of filament 13 (double coiled wire). A central, double coiled, portion of filament 13 extends between first and second focal points F1, F2 of bulbous portion 4. Therefore, optical interference film 6 reflects all of the infrared rays emitted from filament 13 toward filament 13 between focal points F1, F2.

End portions **9*b* and 12*b* of lead wires 9 and 12 are inserted into peripheral, single coiled, portions of filament 13, whereby filament 13 extends between lead wires 9 and 12** as mentioned above.

Therefore, an axis of filament 13 lies along axis O1–O1 of envelope 1. Furthermore, as the wall of bulbous portion 4 has a slope inclined toward thin tube 5, intermediate U-shaped bend portion 8 of lead wire 9 is easily and smoothly inserted into thin tube 5, so that intermediate U-shaped bend portion 8 is not deformed. Thus, when manufacturing incandescent lamp 100, first lead wire 9 is prevented from shifting from central axis O1–O1. In this embodiment thin tube 5 of envelope 1 can be a conventional exhaust tube. However, a thin tube separated from the exhaust tube may be used.

When incandescent lamp 100 is energized, filament 13 heats to a high temperature to generate light including infrared rays and visible light. When the light generated by filament 13 strikes optical interference film 6 through envelope 1, optical interference film 6 transmits visible rays and reflects infrared rays. The infrared rays reflected by optical interference film 6 are returned to filament 13 and reabsorbed by filament 13. The reabsorbed infrared rays reduce the input energy needed to maintain the temperature of filament 13. As a result, the geometrical gain factor becomes high, and the luminous efficiency of incandescent lamp 100 is greatly improved.

According to this embodiment, the position of first lead wire 9 is controlled at the end of envelope 1 opposite sealed portion 2. Therefore, end **9*b* of lead wire 9, connected to filament 13, is held on central axis O1–O1 of envelope 1**. As a result, the geometrical gain factor becomes high.

Next, a manufacturing process for a mount including lead wire 9, lead wire 12 and filament 13 will be described.

As shown in FIG. 3A, as a first step of the manufacturing process, a single straight tungsten wire is bent so as to form the intermediate U-shaped bend portion 8 and overhang 17 which will be located near filament 13. Then, as shown in FIG. 3B, the ends of the tungsten wire are coupled by glass support bridge 16. Next, as shown in FIG. 3C, the tungsten wire is cut at predetermined positions to form a space across which filament 13 (not shown) will extend. As a result, lead wire 9 and second lead wire 12 are separated from each other. Finally, filament 13 is attached between lead wires 9 and 12, completing the mount (shown in FIG. 3D).

Figure 5:
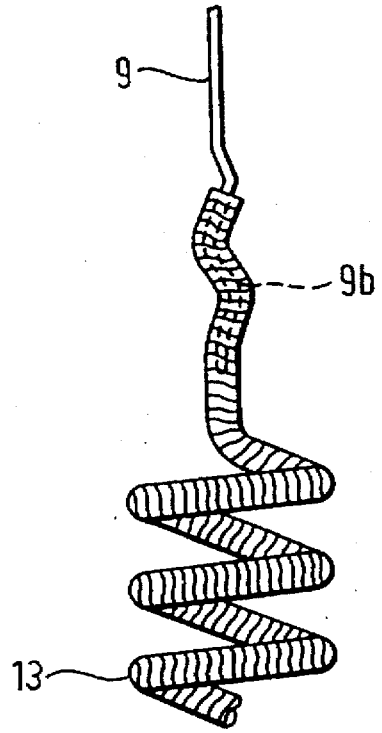
FIG. 5 is a greatly enlarged detailed elevation and broken view of an incandescent lamp of the present invention.

Another embodiment in accordance with the present invention is shown in FIGS. 4 and 5. Like reference characters designate identical or corresponding elements of the above disclosed first embodiment. The construction and operation of the following embodiments are substantially the same as the first embodiment and, therefore, a detailed explanation of its operation is not provided.

FIG. 4 shows an incandescent lamp 101 according to a second embodiment of the present invention. Incandescent lamp 101 has an anchor wire 18 fixed in glass support bridge 16. Anchor wire 18 supports filament 13 at an intermediate position of filament 13. According to this embodiment, filament 13 can better withstand shock.

FIG. 5 illustrates one end of filament 13 and one end portion **9*b* of first lead wire 9 according to another embodiment of the present invention. In this embodiment, end portion 9*b* of first lead wire 9 is inserted into a singly-coiled portion of filament 13. End portion 9*b* and the corresponding part of filament 13 are shaped as wave in order to prevent filament 13 from separating from end portion 9*b***.

Figure 6:
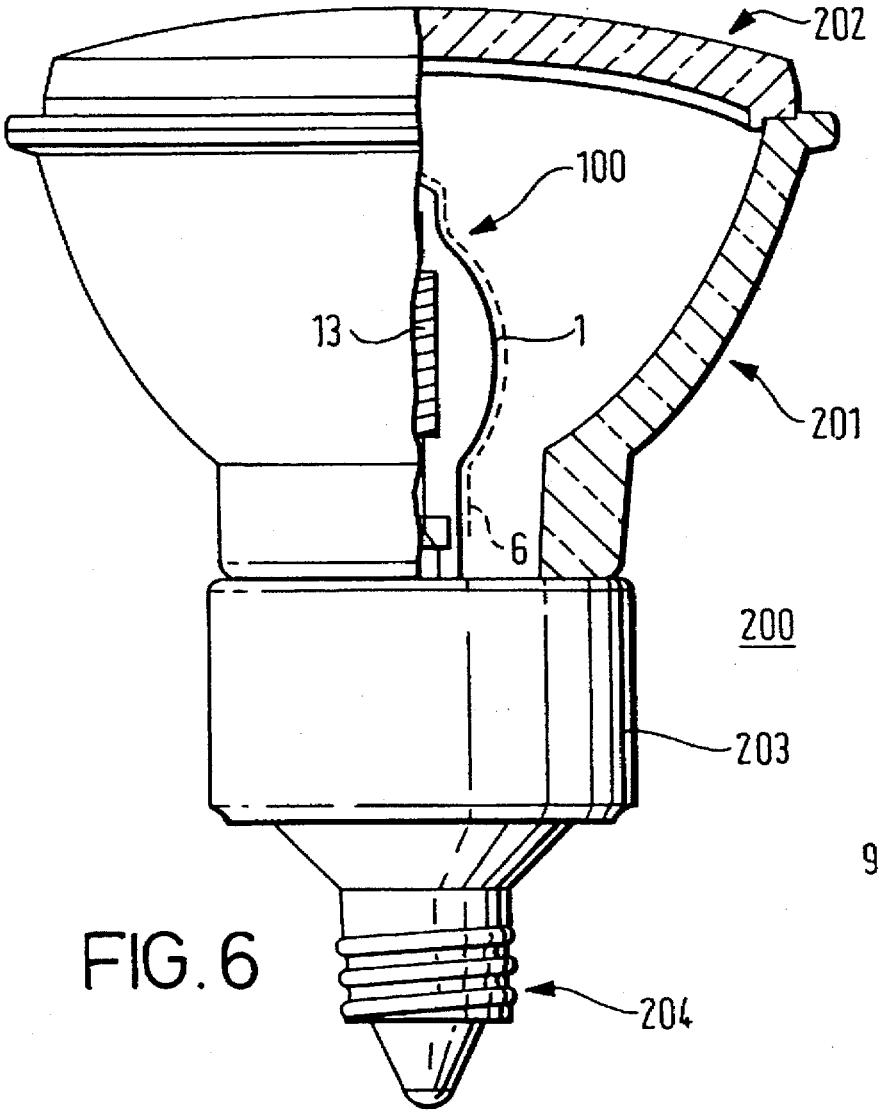
FIG. 6 is a cross sectional and broken view of a lighting apparatus using the incandescent lamp shown in FIGS. 1 and 2.

FIG. 6 shows a lighting apparatus 200 according to an embodiment of the invention, which uses incandescent lamp 100 shown in FIGS. 1 and 2 and a luminaire surrounding it. The lighting apparatus 200 is assembled with incandescent lamp 100, a reflector 201, a front cover 202 and a base 203 having a metal cap 204.

Reflector 201 is a PAR (parabolic aluminized reflector) made of a soft glass. Incandescent lamp 100 is arranged in reflector 201. Front cover 202 is fixed on the front edge of reflector 201 by an epoxy resin glue. Glass welding may be used to fix front cover 202 and reflector 201. Reflector 201 has an aluminized reflection film coated on the inner surface of reflector 201. However, a conventional dichroic mirror may be used.

Base 203 is mounted on the rear edge of reflector 201, whose metal cap 204 is electrically connected to the outer lead wires (not shown) of incandescent lamp 100.

When incandescent lamp 100 is energized, filament 13 heats up to a high temperature to generate light including infrared rays and visible rays. When the light generated by filament 13 reaches optical interference film 6 through envelope 1, optical interference film 6 transmits visible light and reflects infrared rays. The visible light transmitted through optical interference film 6 is reflected by reflector 201, and thus, radiates toward the outside of lighting apparatus 200 through front cover 202. Infrared rays reflected by optical interference film 6 return to filament 13 and heat up filament 13. As a result, a luminous efficiency of incandescent lamp 100 is greatly improved.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. An incandescent lamp, comprising:

an envelope having a bulbous portion including a wall defining a space, a thin tube extending outwardly along a central axis of said bulbous portion so as to communicate with said space, and a sealed portion located on an opposite end of said bulbous portion from said thin tube, said wall having a slope inclined toward said thin tube;

a filament provided along said central axis of said bulbous portion;

an optical interference layer arranged on a surface of said wall for reflecting infrared rays toward said filament;

a first lead wire having a first end portion fixed in said sealed portion of said envelope, a second end portion coupled to one and of said filament and an intermediate U-shaped portion inserted into said thin tube for regulating a position of said filament; and a second lead wire having a first end portion fixed in said sealed portion of said envelope and a second end portion coupled to another end of said filament.

2. The incandescent lamp according to claim 1, wherein said bulbous portion further includes a spheroidal portion having two focuses, each of said two focuses being positioned near one end of said filament, respectively.

3. The incandescent lamp according to claim 1, wherein said first lead wire is made of one continuous wire.

4. The incandescent lamp according to claim 1, wherein said filament is formed of a double coiled wire.

5. The incandescent lamp according to claim 4, wherein said second end portion of said first lead wire is inserted into said double coiled wired for coupling therebetween.

6. The incandescent lamp according to claim 5, wherein said second end portion of said second lead wire is inserted into said double coiled wire for coupling therebetween.

7. The incandescent lamp according to claim 1, wherein said thin tube of said envelope has an inner diameter of 2.5 to 6.0 mm and said first lead wire has a diameter of 0.2to 0.55 mm.

8. The incandescent lamp according to claim 1, further comprising a glass support bridge disposed between said filament and said sealed portion of said envelope, said first and second lead wires penetrating through said glass support bridge.

9. The incandescent lamp according to claim 8, further comprising an anchor wire fixed in said glass support bridge for supporting said filament at an intermediate position of said filament.

10. The incandescent lamp according to claim 8, wherein said envelope includes a cylindrical neck portion disposed between said filament and said glass support bridge.

11. The incandescent lamp according to claim 1, wherein said slope of said wall is inclined at an angle of no more than 70° from said central axis of said bulbous portion.

12. Lighting apparatus comprising:

an incandescent lamp which includes:

an envelope having a bulbous portion including a wall defining a space, a thin tube extending outwardly along a central axis of said bulbous portion so as to communicate with said space, and a sealed portion located on an opposite end of said bulbous portion from said thin tube, said wall having a slope inclined toward said thin tube, a filament provided along said central axis of said bulbous portion, an optical interference layer arranged on a surface of said wall for reflecting infrared rays toward said filament, a first lead wire having a first end portion fixed in said sealed portion of said envelope, a second end portion coupled to one end of said filament and an intermediate U-shaped portion inserted into said thin tube for regulating a position of said filament, and a second lead wire having a first end portion fixed in said sealed portion of said envelope and a second end portion coupled to another end of said filament; and a luminaire housing said incandescent lamp.

13. The incandescent lamp according to claim 1, wherein said second end portion of said first lead wire is inserted into said filament for coupling therebetween.

14. The incandescent lamp according to claim 5, wherein said second end portion of said second lead wire is inserted into said filament for coupling therebetween.

* * * * *